United States Patent [19]

Funaki

[11] Patent Number: 4,890,433

[45] Date of Patent: Jan. 2, 1990

[54] TILE MOUNTING PLATE AND TILED WALL STRUCTURE

[76] Inventor: Motokatsu Funaki, 430 Shimotsuchidana, Fujisawa-shi, Kanagawa-ken, Japan

[21] Appl. No.: 210,478

[22] Filed: Jun. 21, 1988

[30] Foreign Application Priority Data

Dec. 15, 1987 [JP] Japan ..... 62-315096
Dec. 15, 1987 [JP] Japan ..... 62-315097
Feb. 2, 1988 [JP] Japan ..... 63-21304

[51] Int. Cl.[4] ..... E04F 13/08

[52] U.S. Cl. ..... 52/386; 52/510; 52/385

[58] Field of Search ..... 52/386, 384, 391, 385, 52/389, 510, 795

[56] References Cited

U.S. PATENT DOCUMENTS 3,005,293 10/1961 Hunter ..... 52/510 X
4,238,915 12/1980 Yoshida et al. ..... 52/386 X

FOREIGN PATENT DOCUMENTS 0287391 10/1988 European Pat. Off. ..... 52/384

*Primary Examiner*—Carl D. Friedman
*Attorney, Agent, or Firm*—Blum Kaplan

[57] ABSTRACT

A tile mounting plate capable of exhibiting strength sufficient to safely and positively hold tile blocks thereon and preventing leakage of water. The tile mounting plate is formed thereon with a plurality of first laterally extending projection and second laterally extending projection. The first projections are arranged so as to be vertically parallel to one another at intervals corresponding to vertical intervals between tile blocks and each formed into dimensions sufficient to cause it to be inserted in a dovetaile groove of the tile block. The second projections each are arranged below each of the first projections so as to form a tile support mechanism in cooperation with the first projection. The projections are formed by forming. A tiled wall structure employing the tile mounting plate is also disclosed.

17 Claims, 8 Drawing Sheets

TILE MOUNTING PLATE AND TILED WALL STRUCTURE

BACKGROUND OF THE INVENTION

1. Field of the Invention

This invention relates to a tile mounting plate and a tiled wall structure, and more particularly to a tile mounting plate for mounting tile blocks thereon to construct a tiled wall such as an outer wall of a building, its inner wall or the like and a tiled wall structure using such a tile mounting plate.

2. Description of the Prior Art

A tile mounting plate which has been conventionally used for such a purpose as described above is disclosed in Japanese Patent Application No. 48862/1987 and generally constructed in such a manner as shown in FIGS. 1 and 2.

More particularly, FIG. 1 shows a conventional tiled wall structure used as an outer wall of a building, wherein a tile mounting plate generally designated by reference numeral 100 is fixed on an outer surface of a wall base (not shown) of a building through suitable means 102 such as a backing member, a common rafter or the like and tile blocks 104 are supportedly arranged on an outer surface of the tile mounting plate 100, thus, a tiled wall is formed. For this purpose, the mounting plate 100, as shown in FIG. 2, is provided on an outer surface thereof with a plurality of substantially L-shaped holding pawls 106 arranged at predetermined intervals in a lateral direction thereof and in a plurality of rows at predetermined intervals in a vertical direction thereof. The tile blocks 104 are held on the tile mounting plate 100 through the holding pawls 106. The holding pawls 106 each are formed into a substantially L-shape by raising a part of the tile mounting plate 100. Correspondingly, the tile blocks 104 each are formed on an inner surface thereof with recesses 108, in which the holding pawls 106 are received to hold the tile block 104 on the tile mounting plate 100. The tile mounting plate 100 and tile blocks 104 are constructed in the manner described above, resulting in mounting of the tile blocks 104 on the tile mounting plate 100 taking place upwardly from a lower portion of the tile mounting plate 100 in turn.

As described above, the conventional mounting operation of the tile blocks on the mounting plate is carried out by merely hookedly engaging the recesses formed at the inner surface of each tile block with the holding pawls formed on the outer surface of the mounting plate by raising. Unfortunately, such a mounting manner fails to ensure positive and safe mounting of the tile blocks on the mounting plate. Also, as described above, the tile blocks are mounted on the mounting plate upwardly from the lower portion of the mounting plate in order. Accordingly, when a scaffold is assembled or rebuilt for mounting the tile blocks on an upper portion of the mounting plate or disassembled, tile blocks which have been already arranged on the mounting plate are often caused to be damaged or soiled. Also, disassembling of the scaffold cannot be accomplished prior to completion of arrangement of tile blocks on the mounting plate. Thus, it will be noted that the prior art deteriorates operability in arrangement of the tile blocks on the mounting plate.

Also, the prior art causes formation of a gap between the tile blocks mounted on the mounting plate, which is filled with a joint sealer to prevent rain water from entering the gap. Unfortunately, the joint sealer is apt to produce cracking due to a change with time, a variation of a temperature and the like, to thereby fail to fully prevent entrance of rainwater. Rainwater entering the gap then penetrates through holes formed by providing the mounting plate with the holding pawls into an inside of the tiled wall structure and a wall base of a building, resulting in leakage of rainwater.

Further, the conventional mounting plate is formed at a flat section thereof with a plurality of the holding pawls by raising parts of the flat sections. Unfortunately, the flat section essentially fails to exhibit high strength or rigidity. Accordingly, such formation of the holding pawls at the flat section deteriorates strength and rigidity of the tile mounting plate. However, the prior art does not take any steps necessary to reinforce the mounting plate. Accordingly, the tile mounting plate fails to exhibit satisfactory durability and safety because it must support relatively weighty tile blocks thereon in spite of being inferior in strength and rigidity as described above. In view of such a problem, it is proposed that the mounting plate is formed of aluminum by extrusion molding which permits the holding pawls to be formed integral with the mounting plate. Nevertheless, a mounting plate formed of aluminum by extrusion molding is deteriorated in heat resistance, particularly, fire resistance, to a degree to readily cause its thermal deformation when it reaches its critical temperature. Accordingly, it fails to safely support the tile blocks thereon when it is exposed to a high temperature.

Accordingly, it would be highly desirable to provide a tile mounting plate which is capable of exhibiting strength and rigidity sufficient to safely and positively hold tile blocks thereon, effectively preventing leakage of rainwater and permitting tile blocks to be upwardly arranged from its lower end in turn and a tiled wall structure employing such a tile mounting plate.

SUMMARY OF THE INVENTION

Generally speaking, in accordance with one aspect of the present invention, a tile mounting plate is provided which is adapted to securely vertically and laterally arrange a plurality of tile blocks thereon through a dovetail groove formed on an inner surface of each of the tile blocks. For this purpose, the tile mounting plate is formed thereon with a plurality of first laterally extending projections and a plurality of second laterally extending projections in a manner to be outwardly expanded or projected therefrom. The first projections are arranged in a manner to be parallel to one another in a vertical direction of the tile mounting plate at intervals corresponding to intervals between the tile blocks vertically arranged adjacent to each other and each are formed into dimensions sufficient to cause it to be loosely fitted in the dovetail groove of the tile block. The second projections each are arranged below each of the first projections so as to form tile support means for supporting the tile blocks thereon in cooperation with the first projection adjacently positioned above the second projection. The first projection is expandedly formed so that it includes an obliquely upwardly extending upper wall for engagedly supporting an upper surface of the dovetail groove of the tile block thereon, an obliquely downwardly extending lower wall, and a front wall for connecting the upper wall and lower wall to each other therethrough and abuttedly supporting a bottom surface of the dovetail groove of the tile block thereon, resulting in defining a dovetail groove therein. The second projection is formed into a shape sufficient to cause tile holding means to be fixedly interposed between the second projection and the lower wall of the first projection to securely hold the tile block on the tile holding means and cause the second projection to support an inner surface of the tile block thereon. Also, the second projection is formed into a height smaller than that of the first projection so that a difference between the heights of the first and second projections substantially equal to a depth of the dovetail of the tile block.

In a preferred embodiment of the present invention, the second projection is expandedly formed so that it includes an obliquely upwardly extending upper wall so as to cause the tile holding means to be fixedly interposed between it and the lower wall of the first projection, a obliquely downwardly extending lower wall, and a front wall for connecting the upper wall and lower wall to each other therethrough and abuttedly supporting an inner surface of the tile block thereon, resulting in a dovetail groove being formed therein.

In accordance with another aspect of the present invention, a support structure for a tiled wall is provided. The support structure includes a tile mounting plate and at least one backing member for mounting the mounting plate on a wall base of a building. The mounting plate is formed thereon with a plurality of laterally extending projections which are arranged in a manner to be parallel to one another in a vertical direction of the mounting plate at intervals corresponding to intervals between tile blocks each formed with a dovetail groove and vertically arranged adjacent to each other and each of which is formed into dimensions sufficient to cause it to be loosely fitted in the dovetail groove of the tile block. Also, the projections each are formed in a manner to be expanded or projected from the tile mounting plate so as to define a dovetail groove therein. The backing member is formed on a surface thereof facing the mounting plate with raised projections hookedly engaged with an inner surface of the dovetail groove of at least a part of the projections of the tile mounting plate at predetermined intervals in a manner to be obliquely upwardly projected.

In a preferred embodiment of the present invention, the raised projections of the backing member are arranged at intervals substantially equal to those of the projections and hookedly engaged with all the projections.

In accordance with a further aspect of the present invention, a tiled wall structure is provided. The tiled wall structure includes a plurality of tile blocks each formed therein with a dovetail groove, a tile mounting plate formed thereon with a plurality of first laterally extending projections and a plurality of second laterally extending projections, at least one backing member for mounting the mounting plate on a wall base of a building, and an elastic fixture for fixing each of the tile blocks on the mounting plate. The first projections are arranged in a manner to be parallel to one another in a vertical direction of the mounting plate at intervals corresponding to intervals between the tile blocks vertically arranged adjacent to each other and each are formed into dimensions sufficient to cause it to be loosely fitted in the dovetail groove of the tile block. The second projections each are arranged below each of the first projections so as to form tile support means for supporting the tile blocks thereon in cooperation with the first projection adjacently positioned above the second projection. The first projection is expandedly formed so that it includes an obliquely upwardly extending upper wall for engagedly supporting an upper surface of the dovetail groove of the tile block thereon, an obliquely downwardly extending lower wall, and a front wall for connecting the upper wall and lower wall to each other therethrough and abuttedly supporting a bottom surface of the dovetail groove thereon, resulting in defining a dovetail groove therein. The second projection is formed into a shape sufficient to cause tile holding means to be fixedly interposed between the second projection and the lower wall of the first projection to securely hold the tile block on the tile holding means and cause the second projection to abuttedly support an inner surface of the tile block thereon. Also, the second projection is formed into a height smaller than that of the first projection so that a difference between the heights of the first and second projections is substantially equal to a depth of the dovetail of the tile block. The backing member is formed on a surface thereof facing the mounting plate with raised projections hookedly engaged with an inner surface of the dovetail groove of at least a part of the projections of the tile mounting plate at predetermined intervals in a manner to be obliquely upwardly projected therefrom. The elastic fixture is elastically fixedly interposed between the lower wall of the first projection of the mounting plate and the second projection to elastically pressedly holding the tile block engagedly supported on the first projection through the dovetail groove at a position.

Accordingly, it is an object of the present invention to provide a tile mounting plate which is capable of exhibiting strength sufficient to stably and safely mount tile blocks thereon.

It is another object of the present invention to provide a tile mounting plate which is capable of permitting arrangement of tile blocks thereon to be accomplished in an upward direction from a lower portion thereof.

It is a further object of the present invention to provide a tile mounting plate which is capable of positively and firmly mounting tile blocks thereon.

It is still another object of the present invention to provide a support structure for a tiled wall which is capable of causing a tile mounting plate to effectively exhibit sufficient strength.

It is yet another object of the present invention to provide a support structure for a tiled wall which is capable of effectively preventing leakage of rainwater.

It is even another object of the present invention to provide a tiled wall structure which is capable of being readily assembled.

It is still a further object of the present invention to provide a tiled wall structure which is capable of permitting tile blocks to be positively and safely arranged thereon.

It is yet a further object of the present invention to provide a tiled wall structure which is capable of positively preventing leakage of rainwater.

It is an even further object of the present invention to provide a tiled wall structure which is capable of exhibiting good aesthetic feeling.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with accompanying drawings; wherein.

DETAILED DESCRIPTION OF THE PREFERRED EMBODIMENTS

Figure 2:
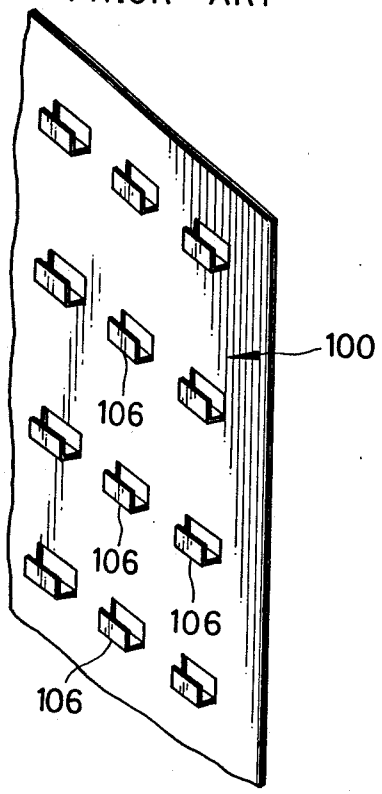
FIG. 2 PRIOR ART
FIG. 2 is a fragmentary perspective view showing a conventional tile mounting plate used in the conventional tiled wall structure shown in FIG. 1.
Figure 1:
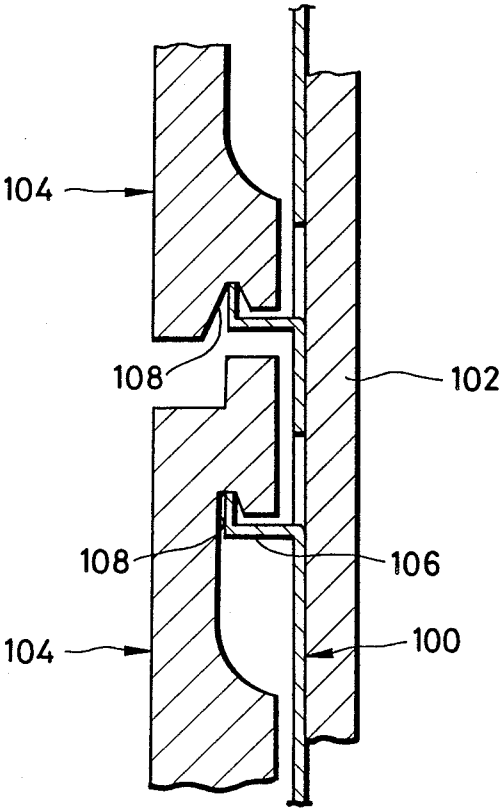
FIG. 1 PRIOR ART
FIG. 1 is a fragmentary vertical sectional view showing a conventional tiled wall structure.

Now, the present invention will be detailedly described hereinafter with reference to FIGS. 3 to 10, in which like reference numerals designate like or corresponding parts throughout.

Figure 3:
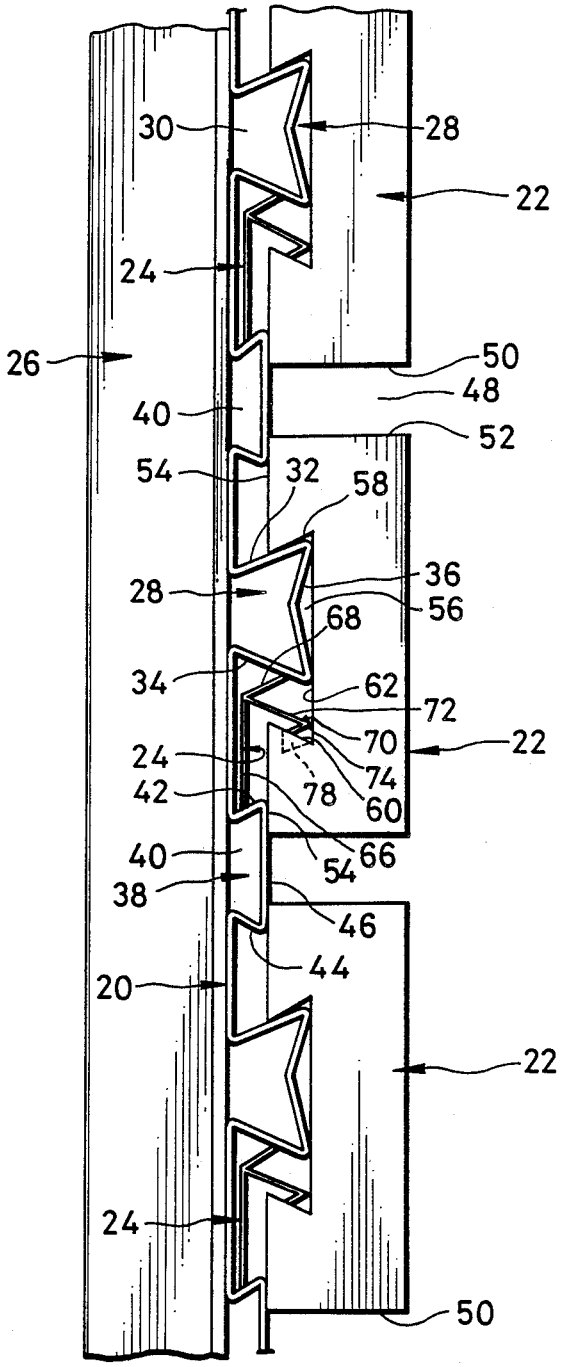
FIG. 3 is a fragmentary side elevation view showing one embodiment of a wall structure according to the present invention.
Figure 4:
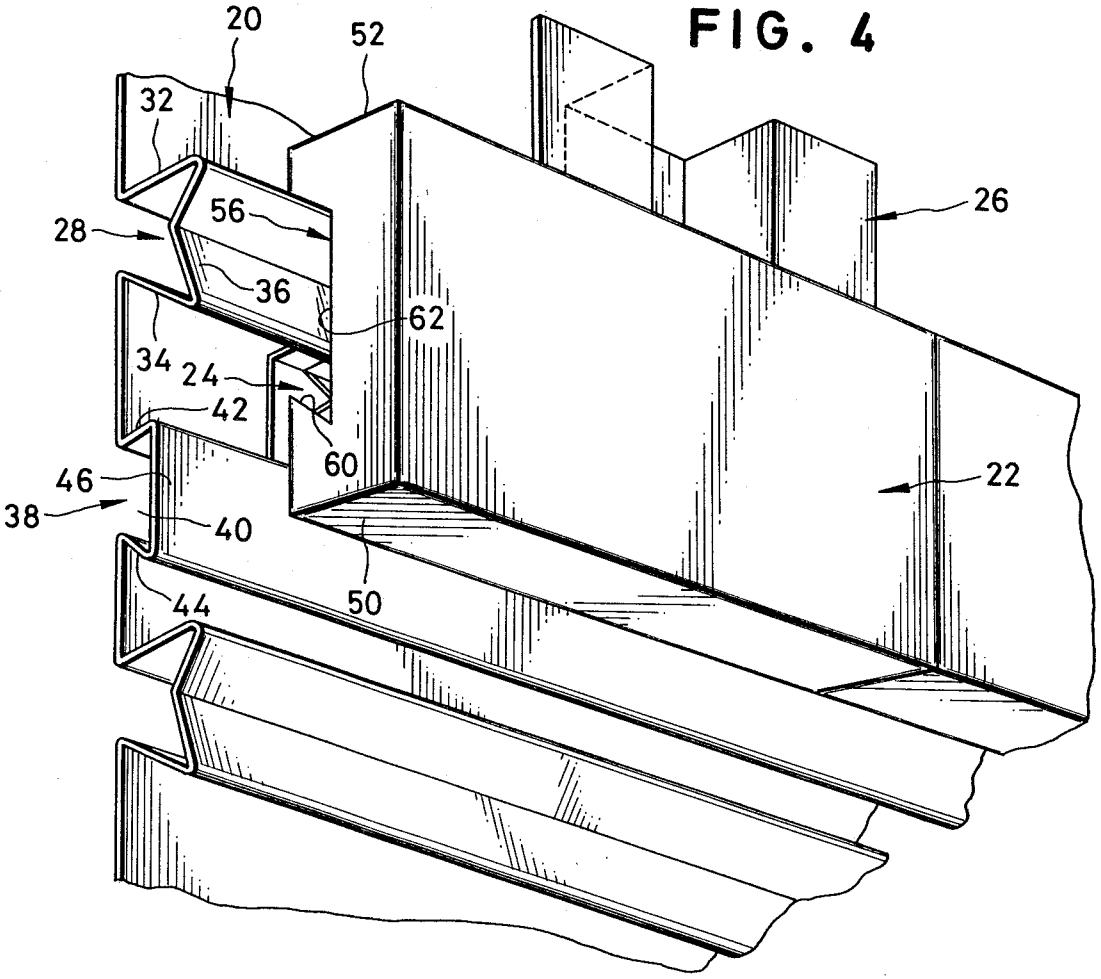
FIG. 4 is a fragmentary perspective view of the tiled wall structure shown in FIG. 3.
Figure 5:
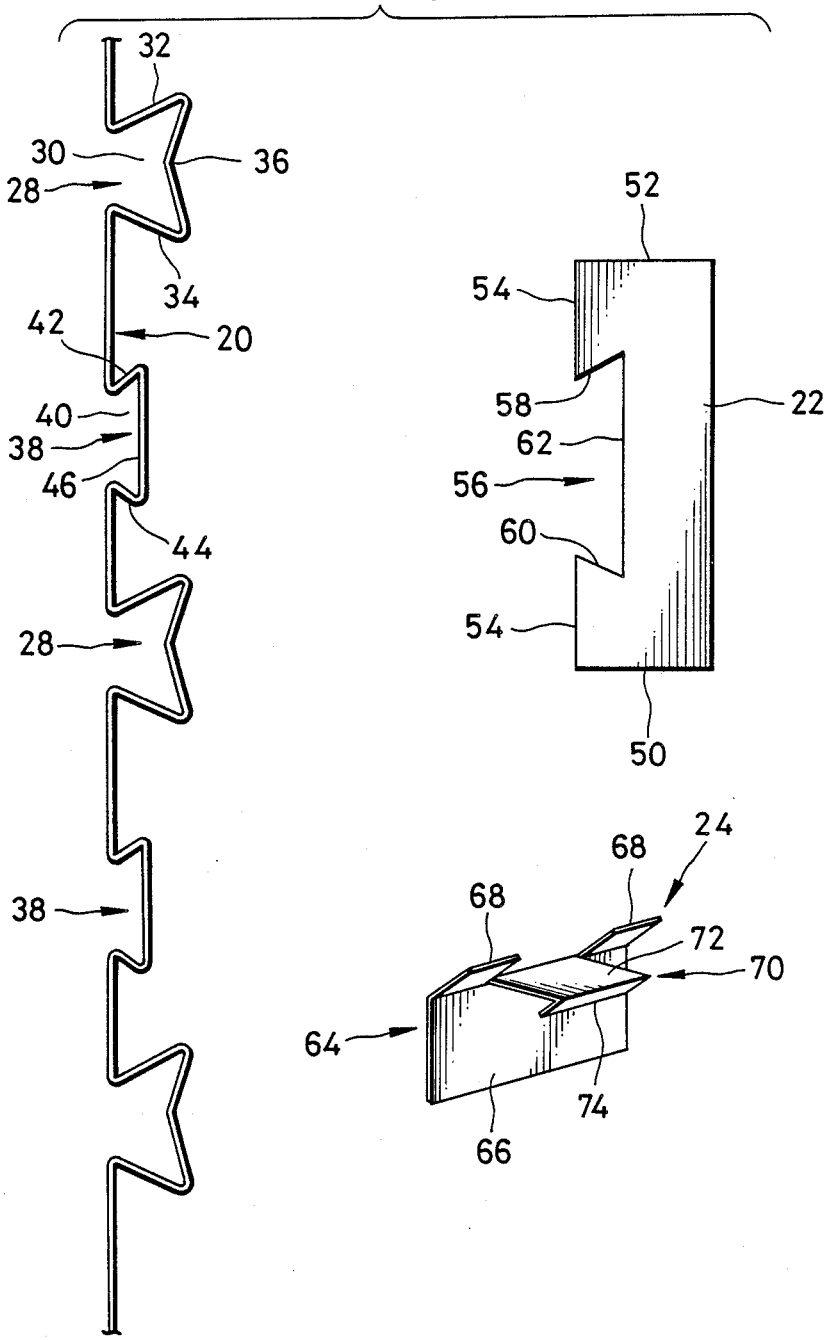
FIG. 5 is an exploded perspective view of the tiled wall structure shown in FIG. 3.

FIGS. 3 to 5 show an embodiment of a tiled wall structure of the present invention in which a tile mounting plate of the present invention is incorporated and is constructed in the form of an outer wall of a building.

As shown in FIGS. 3 to 5, a tiled wall structure of the illustrated embodiment includes a tile mounting plate, tile blocks and elastic fixtures serving as tile holding means generally designated at reference characters 20, 22 and 24, respectively.

The tile mounting plate 20 of the illustrated embodiment is adapted to be mounted at one surface or an inner surface thereof through suitable means 26 such as a backing material, common rafter or the like on a wall base of a building. The tile blocks 22 are mounted on the other surface of an outer surface of the mounting plate 20. In the illustrated embodiment, at least one backing member is used as the means 26.

The tile mounting plate 20 is provided on its outer surface with a plurality of first laterally extending projections 28. The first projections 28 are arranged in parallel to one another in a vertical direction of the mounting plate 20 at intervals corresponding to intervals between the tile blocks 22 vertically arranged adjacent to each other and each are formed in a manner to be outwardly expanded or projected from the plate 20 so as to define a dovetail groove 30 therein. More particularly, each of the first projections 28 is so formed that it includes an obliquely upwardly extending upper wall 32, an obliquely downwardly extending lower wall 34, and a front wall 36 for connecting the upper wall 32 and lower wall 34 to each other therethrough. In the illustrated embodiment, the front wall 36 is formed into a dogleg-like shape in its vertical section so that it may absorb a variation of a vertical dimension of the mounting plate 20 due to thermal expansion and shrinkage. Also, formation of the front wall 36 into such a shape causes it to be intimately contacted with the tile block 22 to prevent rainwater from being collected between the front wall 36 and the tile block 22, as detailedly described hereinafter. The upper wall 32 and lower wall 34 of the projection 28 serve as a tile supporting surface and a tile holding surface for elastically holding it, respectively, as described below.

Also, the tile mounting plate 20 is provided on its outer surface with a plurality of second laterally extending projections 38. The second projections 38 each are arranged below each of the first projections 28 at a predetermined interval and formed in a manner to be outwardly expanded or projected form the plate 20, resulting in a dovetail groove 40 being defined therein. More particularly, each of the second projections 38 is so formed that it includes an obliquely upwardly extending upper wall 42, an obliquely downwardly extending lower wall 44, and a front wall 46 for connecting the upper wall 42 and lower wall 44 to each other therethrough.

Each of the second projection 38 is adapted to form each tile support means for fixedly supporting the tile blocks thereon in cooperation with the first projection 28 adjacently positioned above the second projection 38. More particularly, the upper wall 42 of the second projection 38 serves as a fixture holding surface which securely holds the elastic fixture 24 thereon in cooperation with the lower wall 34 of the corresponding first projection 28 so as to cause the tile block 22 to be elastically securely held through the elastic fixture 24 on the mounting plate 20, and the front wall 46 of the second projection 38 serves to abuttedly support lower and upper portion of an inner surface 54 of the vertically adjacent two tile blocks 22. For this purpose, the front wall 46 is preferably formed into a flat shape.

The above-described first and second projections 28 and 38 may be formed by forming. The formed projections are preferably provided with round corners. The tile mounting plate 20 provided with the projections may be formed of a metal sheet of predetermined strength by forming.

The tile blocks 22 to be mounted on the tile mounting plate 20 constructed as described above, as shown in FIGS. 3 to 5, each are formed into a longitudinal dimension or height somewhat smaller than an interval between each vertically adjacent two first projections 28 of the mounting plate 20, so that a gap 48 may be defined between a lower end surface 50 and an upper end surface 52 of each vertically adjacent two tile blocks 22, as shown in FIG. 3.

Each of the tile blocks 22 is formed at a central portion of the inner surface 54 thereof with a laterally extending dovetail groove 56. More particularly, the dovetail groove 56 includes an upper surface 58 obliquely upwardly extending from the inner surface 54, a lower surface 60 obliquely downwardly extending from the inner surface 54, and a bottom surface 62 for connecting the upper and lower surfaces 58 and 60 to each other. The dovetail groove 56 of the tile block 22 is formed at an entrance thereof into a size larger than that of the first projection 28 of the mounting plate 20 and also it is formed into a depth smaller than a height of the projection 28, so that the upper surface 58 of the dovetail groove 56 may be hookedly engaged with the upper wall 32 of the first projection 28 of the mounting plate 20. Further, the inner surface 54 of the tile block 22, as described above, is adapted to be abuttedly supported at a lower portion thereof on the front wall 46 of the second projection 38 of the mounting plate 20. For this purpose, the second projection 38 is formed into a height smaller than that of the first projection 28 so that a difference in a height between the first projection 28 and the second projection 38 is substantially equal to or slightly smaller than the depth of the dovetail groove 58 of the tile block 22.

Each of the elastic fixtures 24 for fixing the tile blocks 22 on the mounting plate 20, as shown in FIGS. 3 and 4, is fixedly interposed between the lower end 34 of the first projection 28 and the upper wall 42 of the second projection 38 opposite to each other and elastically engaged with the lower surface 62 of the dovetail groove 56 of the tile block 22 to securely hold the tile block 22 on the tile mounting plate 20. For this purpose, the elastic fixture 24, as shown in FIG. 5, is provided with a holding section 64 of a substantially dogleg-like shape held between the corresponding first and second projections 28 and 38. The holding section 64, as shown in FIG. 5, includes a vertically extending lower portion 66 engagedly held at a lower end thereof on the upper wall 42 of the second projection 38 and an upper portion 68 obliquely upwardly extending from an upper end of the lower portion 66 and held at an upper end thereof on the lower wall 34 of the first projection 28. The elastic fixture 24 also includes an engagement section 70 firmly elastically engaged with the lower surface 60 of the dovetail groove 56 of the tile block 22 to hold the tile block 22 on the mounting plate 20. In the illustrated embodiment, the engagement section 70 includes an engagement body 72 formed by cutting an intermediate region of the upper portion 68 and obliquely downwardly bending the region from the portion 68 and a pressing portion 74 formed by downwardly bending a tip end of the engagement body 72 so as to form an acute angle between the pressing portion 74 and the engagement portion 72 and adapted to downwardly elastically press the lower surface 60 of the dovetail groove 56 of the tile block 22. Thus, in the illustrated embodiment, the upper portion 68 of the holding section 62 is laterally separated into two areas with the engagement section 70 being interposed therebetween.

The elastic fixture 24 constructed so as to exhibit elasticity and rigidity as described above may be formed of a suitable steel sheet such as a spring steel sheet or the like. When it is required to exhibit corrosion resistance, it may be conveniently formed of stainless steel. In the elastic fixture 24 constructed as described above, the upper portion 68 may be eliminated by interposing the lower portion 66 between the lower wall 34 of the first projection 28 and the upper wall 42 of the second projection 38 opposite to each other utilizing its own elasticity. Likewise, the pressing portion 74 may be eliminated by pressing the engagement body 72 against the lower surface 60 of the dovetail groove 56 of the tile block 22 utilizing elasticity of the engagement body 72.

Now, the manner of assembling of the tiled wall structure of the illustrated embodiment constructed as described above will be described in connection with an outer wall of a building.

As shown in FIG. 3, a plurality of the mounting plates 20 are mounted on the backing member 26 fixed on a wall base of a building (not shown) by means of tapping screws or the like and then connected to one another. Then, the holding section 64 of the elastic fixture 24 is securely interposed between the lower wall 34 and upper wall 42 of each corresponding first and second projections 28 and 38 opposite to each other. More particularly, the lower end of the lower portion 66 of the elastic fixture 24 is first engagedly held on the upper wall 42 of the second projection 38 of the mounting plate 20 and then the upper portion 68 of the holding section 64 of the elastic fixture 24 is inwardly pushed along the lower wall 34 of the first projection 28 while being flexed against its elasticity until the lower portion 66 of the holding section 64 is substantially abutted against the mounting plate 20, resulting in the elastic fixture 24 being securely held on the mounting plate 20. This causes the engagement body 72 and pressing portion 74 to be positioned near the lower wall 34 of the first projection 28 as shown in FIGS. 3 and 4.

Subsequently, the tile blocks 22 are arranged on the mounting plate 20. More particularly, the pressing portion 74 of the engagement section 70 of the elastic fixture 24 is held on the lower surface 60 of the dovetail groove 56 of the tile block 22. Then, the engagement section 70 is engagedly held on the lower surface 60 of the dovetail groove 56 of the tile block against elasticity of the pressing portion 74 and engagement body 72, and the upper surface 58 of the dovetail groove 56 of the tile block 22 is engagedly abutted against the upper wall 32 of the first projection 28.

The tile block 22 thus mounted on the mounting plate 20 is inwardly and obliquely downwardly forced by the engagement section 70 of the elastic fixture 24 elastically engaged with the lower surface 60 of the dovetail groove 56, so that the upper wall 58 of the dovetail groove 56 is pressed against the upper wall 32 of the first projection 28 to prevent vertical movement of the tile block 22 and the bottom surface 62 of the dovetail groove 56 and the inner surface 54 of the tile block 22 are respectively pressed against the front wall 36 of the first projection 28 and the front wall 46 of the second projection 38 to prevent horizontal movement of the tile block 22. Thus, the tile block 22 is positively and stably arranged on the mounting plate 20. Also, the front wall 36 of the first projection 28 is formed into a dogleg-like portion, so that it may be closely contacted with the tile block 22 irrespective of a degree of finishing of the bottom surface 62 of the dovetail groove 56 of the tile block 22, to thereby prevent rainwater from being collected between the front wall 36 of the first projection 28 and the bottom surface 62 of the tile block 22.

Thus, the tile blocks 22 mounted on the mounting plate 20 are inwardly and obliquely downwardly elastically forced by the engagement section 70 of the elastic fixture 24 elastically engaged with the lower surface 60 of the dovetail groove 56, accordingly, the upper surface 58 of the dovetail groove 56 is pressedly abutted against the upper wall 32 of the first projection 28 to positively prevent vertical movement of the tile block 22. Also, the bottom surface 60 of the dovetail groove 56 and the inner surface 54 of the tile block 22 are respectively pressed against the front wall 36 of the first projection 28 and the front wall 46 of the second projection 38 to prevent horizontal movement of the tile block 22, resulting in the tile blocks 22 being positively and stably arranged on the mounting plate 20. Further, the front wall 36 of the first projection 28 is formed into a dogleg-like shape, so that it may be pressedly contacted with the tile block without being affected by finishing of the bottom surface 62 of the dovetail groove 56 of the tile block 22, resulting in preventing collection of rainwater therebetween even when it enters the dovetail groove 56.

As described above, in the illustrated embodiment, the tile blocks are forcibly held on the mounting plate utilizing elasticity, unlike the prior art wherein the tile blocks are mounted on the mounting plate by mere hooked engagement, so that the mounting may be safely and firmly accomplished. Also, the illustrated embodiment permits the mounting to be practiced in a lateral direction of the mounting plate, as well as downwardly from an upper end of the mounting plate in order.

Thereafter, tile blocks 22 for the lower next stage are laterally arranged in the manner as described above. Repeating of such operation causes the tiled wall structure of the illustrated embodiment to be assembled or constructed wherein the vertically adjacent tile blocks 22 are arranged substantially parallel to one another through the gap 48 defined between the lower end surface 50 and the upper end surface 52 and the laterally adjacent tile blocks 22 likewise are arranged substantially parallel to one another through a predetermined gap therebetween. The gaps may be filled with a joint filler.

Further, in the illustrated embodiment, the first and second projections 28 and 38 of the mounting plate 20 are formed in a manner to be expanded or projected by not raising as in the prior art but forming, so that leakage of rainwater through the mounting plate may be substantially completely prevented. Also, it was found that formation of such expanded projections rather enhanced strength of the mounting plate.

Figure 6:
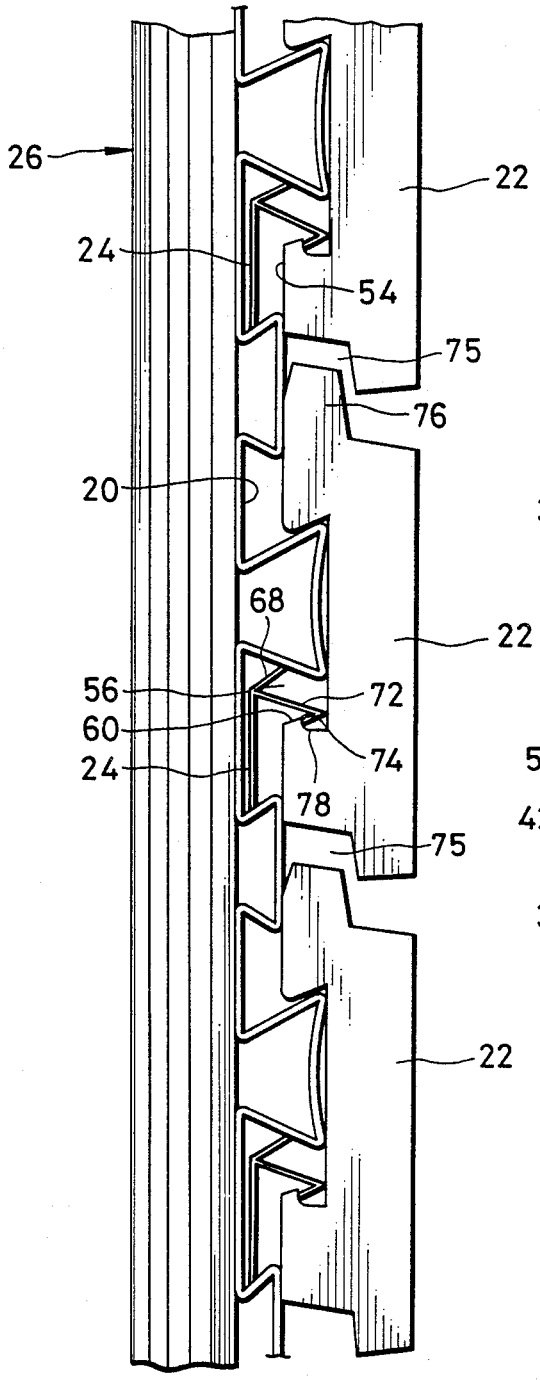
FIG. 6 is a fragmentary side elevation view showing another embodiment of a tiled wall structure according to the present invention.

FIG. 6 shows another embodiment of a tiled wall structure according to the present invention. In the embodiment of FIG. 6, tile blocks 22 each are cut off at a part of a lower portion of an inner surface 54 thereof abutted against a second projection 38 of a mounting plate 22 with a cutout 75. Correspondingly, an upper end of the tile block 22, as indicated at reference numeral 76, is formed in a manner to be upwardly projected so that its shape and dimensions may complementarily correspond to those of the cutout 75 of the inner surface 54 of the tile block 22. This causes lower one of vertically adjacent two tile blocks 22 to be partially inserted at its upper end 76 in the cutout 75 of upper one of the tile blocks, as shown in FIG. 6. Also, in the illustrated embodiment, the tile block 22 is formed on a lower surface 60 of a dovetail groove 56 thereof with a holding recess or step 78.

The remaining of the embodiment shown in FIG. 6 may be constructed in substantially the same manner as the embodiment described above with reference to FIGS. 3 to 5, except that a front wall 36 of a first projection 28 of the mounting plate 20 is curved.

In the embodiment of FIG. 6 described above, when the tile blocks 22 are arranged on the mounting plate 20, lower one of the vertically adjacent two tile blocks 22 is partially inserted at its upper end 76 in the cutout 75 of upper one of the tile blocks, to thereby prevent the mounting plate 22 from being viewed from the outside, resulting in the tiled wall structure exhibiting good aesthetic feeling. Also, the lower surface 60 of the dovetail groove 56 of the tile block 22 is formed with the holding recess 78, so that a pressing portion 74 of an engagement section 70 of an elastic fixture 24 is positively held through the holding recess 78 on the lower surface 60 of the tile block 22 to ensure firmer arrangement of the tile blocks 22 on the mounting plate 20.

Figures 7A, 7B, 7C:
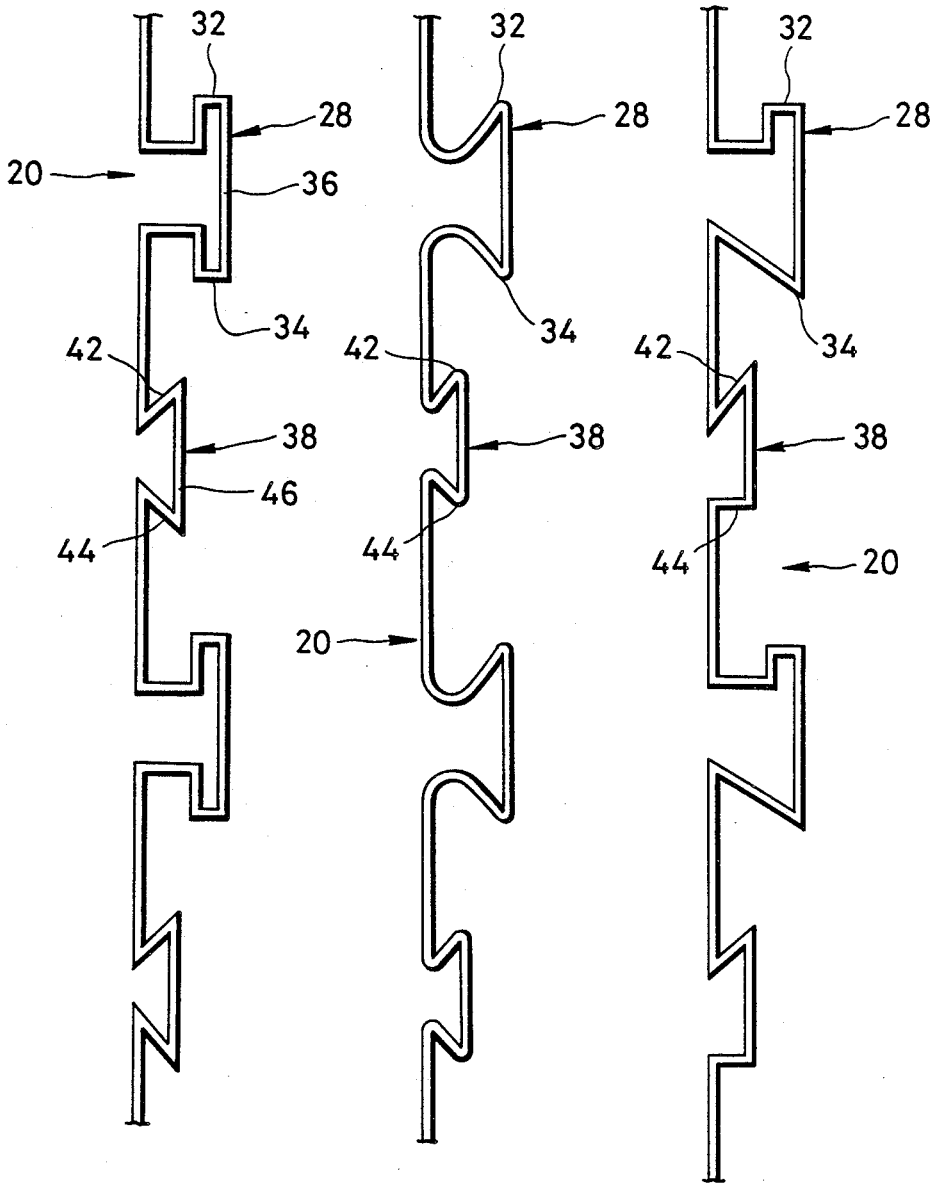
FIGS. 7A to 7C each are a fragmentary side elevation view showing a variation of a tile mounting plate according to the present invention.

FIGS. 7A to 7C each show a modification of the tile mounting plate 22. In a tile mounting plate 22 shown in FIG. 7A, a first projection 28 is formed into a substantially mushroom-like shape and a front wall 36 of the first projection 28 is flatly formed. A tile mounting plate 22 shown in FIG. 7B is constructed substantially the same manner as that of FIG. 7A, except that bent portions of each of first and second projections 28 and 38 are rounded. A tile mounting plate 20 shown in FIG. 7C is constructed in substantially the same manner as that of FIG. 7A, except that a lower wall 34 of a first projection 28 is obliquely formed and a lower wall 44 of a second projection 38 is flatly formed.

As can be seen from the foregoing, the tile mounting plate 20 is formed thereon with a plurality of the first laterally extending projections 28 vertically arranged in a manner to be parallel to one another. The projections 28 each define the dovetail groove 30 therein and include the upper wall 32 acting as the tile supporting surface, the lower wall 34 acting as the tile holding surface, and the front wall 36 which connects the upper and lower walls to each other and with which the bottom surface 62 of the dovetail groove 56 of the tile block 22 is pressedly contacted. The mounting plate 20 is also formed with a plurality of the second laterally extending projections 38 vertically arranged in parallel to each other. The second projections 38 each are arranged below each of the first projections 28 so as to form the tile support means in cooperation with the corresponding first projection adjacently positioned above the second projection and formed into a height smaller than that of the first projection. The second projections 38 each define the dovetail groove 40 therein and include the upper wall 42 acting as the tile holding surface in cooperation with the lower wall 34 of the corresponding first projection 28 and the front wall 46 for abuttedly supporting the inner surface 54 of the tile block 22. Also, the projections may be formed by forming. In the so-constructed mounting plate 20, the tile block 22 formed therein with the dovetail groove 56 is supported on the upper wall 32 of the first projection 28 and held through the elastic fixture 24 by cooperation of the lower wall 34 of the first projection 28 and the upper wall 42 of the second projection 38. Also, the tile block 22 is abuttedly supported at the lower portion of its inner surface 54 on the front wall 42 of the second projection 38. Accordingly, the mounting plate 22 permits mounting of the tile blocks 22 to be readily and efficiently carried out downwardly from the upper portion of the mounting plate 20. Also, the tile blocks are positively and firmly held on the mounting plate 22.

Further, in the mounting plate 20 of each of the embodiment described above, the first and second projection 28 and 38 may be formed in a manner to be expanded from the mounting plate and integral with the mounting plate. Therefore, the mounting plate is free of any raised projection unlike the prior art, resulting in leakage of rainwater through the mounting plate being effectively prevented and strength of the mounting plate being increased to a desired level.

Suitable selection of an interval between the first projection 28 and the second projections 38 prevents heads of screws for fixing the mounting plate 22 on the backing member 26 from being viewed from the outside. Also, the above-described expanded formation of the projections provides the tiled wall structure with enough conspicuousness even when the tile blocks are formed into a small thickness and provides a space between the tile blocks and the mounting plate which is sufficient to prevent the mounting plate from being exposed directly to external heat.

Furthermore, the tile block 22 is tightly abuttedly supported at the upper and lower portions of the inner surface 54 on the front walls 42 of the adjacent second projection 38. This effectively prevents a joint sealer from escaping through the inner surface 54 of the tile block 22 when it is filled in a gap between the vertically adjacent tile blocks, resulting in the joint sealer being substantially saved.

Moreover, each of the embodiment described above permits arrangement of the tile blocks 22 on the tile mounting plate 20 to be accomplished in order in a downward direction from the upper portion of the mounting plate, to thereby prevent previously mounted tile blocks from being damaged during the subsequent mounting operation. Also, this permits disassembling of a scaffold to be downwardly carried out with the progress of the mounting operation.

Figure 8:
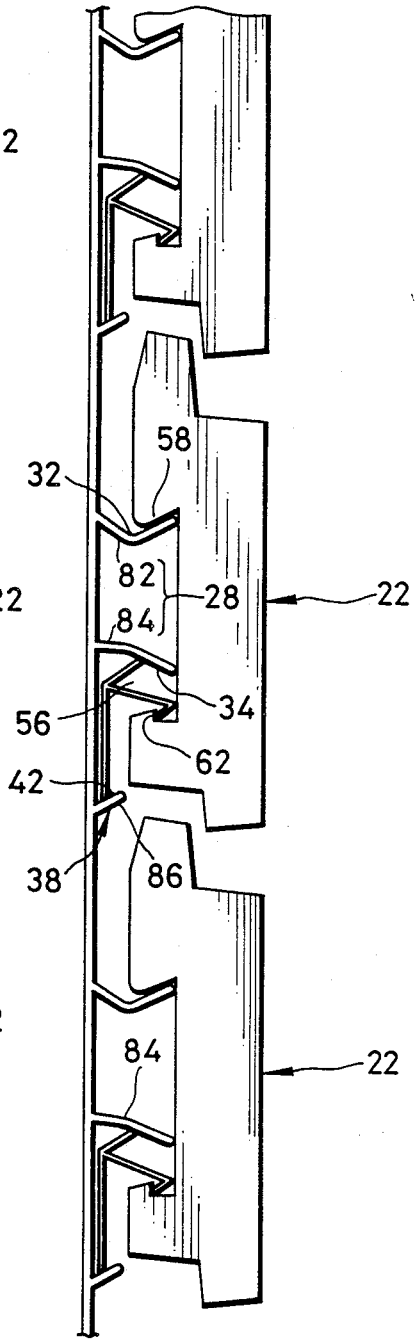
FIG. 8 is a fragmentary side elevation view showing another embodiment of a tiled wall structure according to the present invention.

FIG. 8 shows a further embodiment of a tiled wall structure according to the present invention. A tiled wall structure of FIG. 8 may be constructed in substantially the same manner as the embodiment of FIG. 6 except a mounting plate. More particularly, a tile mounting plate 20 is provided with a plurality of first and second laterally extending projections 28 and 38, as in the embodiment of FIG. 6. The first projections 28 each include a pair of plate members 82 and 84 of a dogleg-like shape projected from a body of the mounting plate 20 and arranged symmetric to each other so as to constitute an upper wall 32 and a lower wall 34 of the projection 28, resulting in a dovetail groove 30 being defined therein which is closed at its entrance and opened at its bottom. Therefore, the front wall 36 in the embodiment of FIG. 6 is eliminated from the embodiment of FIG. 8. Also, in the embodiment, the second projections 38 each comprise an obliquely upwardly projecting plate member 86 and merely serves to hold an elastic fixture 24 in cooperation with the first projection 28 corresponding thereto.

In each of the embodiments described above, mounting of the tile mounting plate on the backing member is carried out by fixing the mounting plate on the backing member from the mounting plate side through holes formed at the mounting plate by means of mounting bolts of strength sufficient to bear weight of a tile block to be mounted. Alternatively, it is carried out by engagedly inserting raised projections of the backing member into holes of the mounting plate and folding back the projections. Unfortunately, such fixing ways have the following disadvantages.

The former method of fixing the mounting plate on the backing member using the mounting bolts requires that the mounting plate with which the tile blocks are directly contacted is formed with a plurality of holes corresponding in diameter to the screws of strength sufficient to bear weight of the tile block. This causes not only rainwater to enter an inside of the wall structure through the holes of the mounting plate to lead to leakage of rain but tightening of the bolts to require much time and labor to render the mounting operation complicated and troublesome. Also, formation of a plurality of the holes at the mounting plate leads to a significant decrease in strength of the mounting plate to deteriorate safety of the plate when a plurality of the tile blocks are mounted thereon.

The above problem of the former method is substantially true of the latter method.

Figure 9:
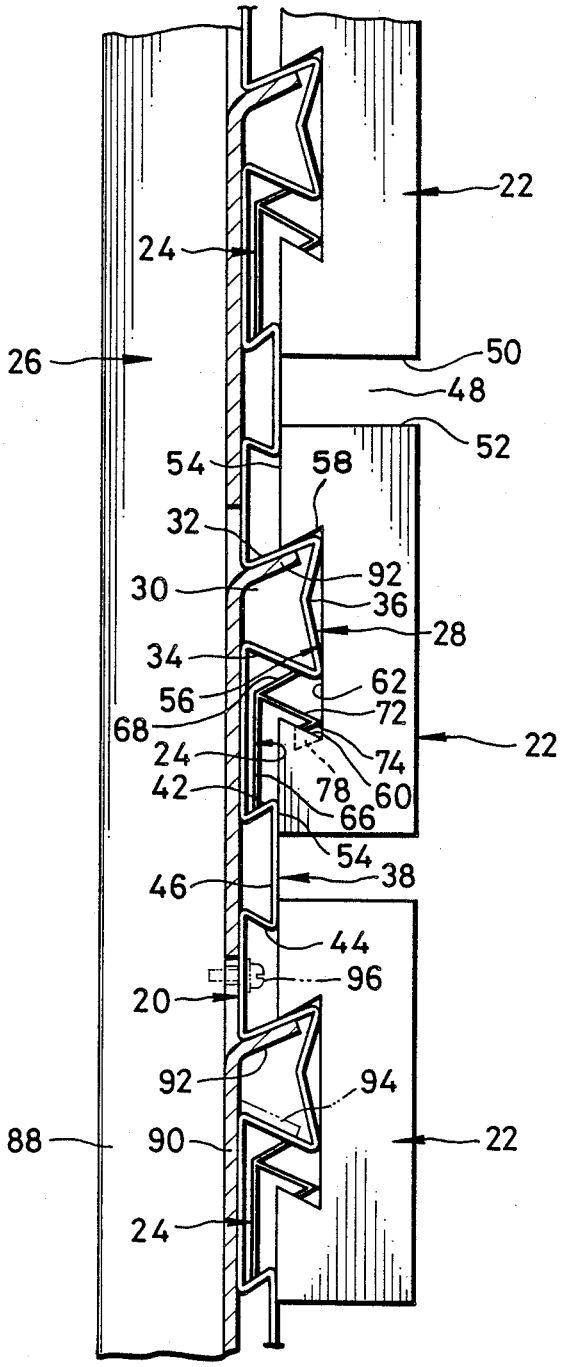
FIG. 9 is a fragmentary vertical sectional view showing a further embodiment of a tiled wall structure according to the present invention.
Figure 10:
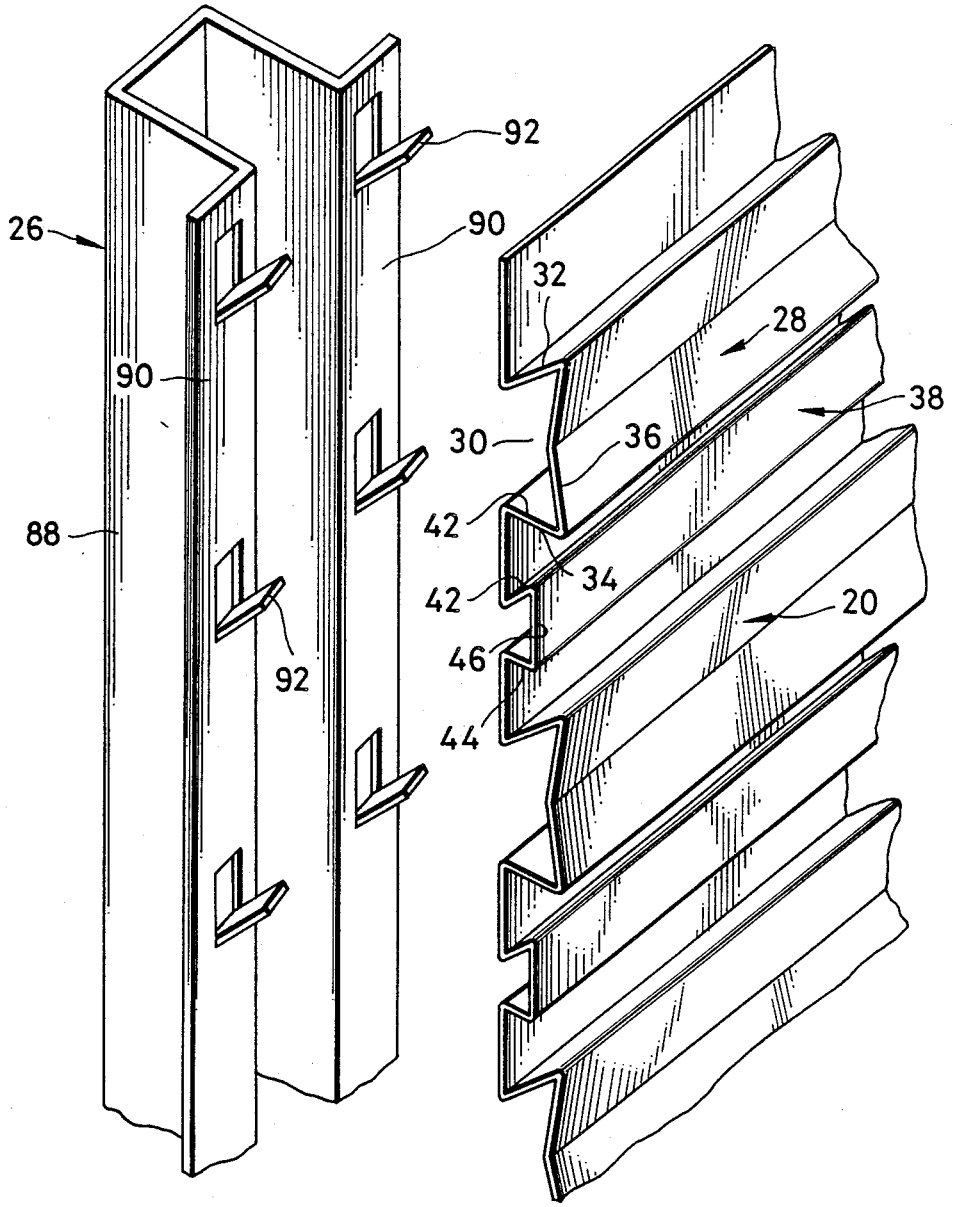
FIG. 10 is a fragmentary exploded perspective view showing an essential part of the tiled wall structure shown in FIG. 9.

FIGS. 9 and 10 show still a further embodiment of a tiled wall structure according to the present invention which is capable of eliminating the above-described problem and adapted to fix a tile mounting plate on at least one backing member without forming the mounting plate with such holes.

In the embodiment of FIGS. 9 and 10, a tile mounting plate 20 is constructed in substantially the same manner as in the embodiments described above. Backing members 26 vertically arranged at predetermined intervals on a wall base of a building each are formed into a hat-like shape in section so as to include a U-shaped body 88 fixed at a bottom thereof on the wall base and flanges 90 provided on both sides of the U-shaped body 88 and extend in a longitudinal direction thereof. The flanges 90 are formed with holding elements 92 at intervals corresponding to vertical intervals of arrangement of first projections 28 of the mounting plate 20. The holding elements 92 each are formed by raising a part of the flange 90 so as to obliquely upwardly project from the flange 90. The backing members 26 of such construction permit the mounting plate 20 to be readily mounted thereon because the mounting is accomplished by merely hookedly engaging an inner surface of an upper wall 32 of each first projection 28 of the mounting plate 20 through a dovetail groove 30 of the first projection 28 with the holding elements 92. Thus, in the illustrated embodiment, the tile mounting plate 20 is readily fixedly supported on the backing members 26 as desired by merely hookedly engaging the mounting plate with the backing members. Then, tile block 22 are arranged on the tile mounting plate 20 in such a manner as described above.

The illustrated embodiment may be so constructed that at least one of the flanges 90 of the backing member 26 is provided with a suitable number of additional raised projections 94 which are adapted to be bent onto an inner surface of a lower wall of the first projection 28, as indicated at two-dot chain lines in FIG. 9. Such construction permits the mounting plate 20 to be more firmly mounted on the backing members 26. Further, in the embodiment, all weight of the tile blocks 22 is applied to the backing members 92 through the holding elements 92. In order to more firmly mount the mounting plate 20 on the backing members 26 in view of this respect, the embodiment may be constructed in such a manner that the mounting plate 20 is mounted on each backing member 26 through each flat portion of the mounting plate 20 between the second projection 38 and the first projection 28 by means of waterproof screws 96 as indicated at two-dot lines in FIG. 9. An experiment by the inventor revealed that such screwing does not cause not only leakage of water because the flat portion is substantially watertightly covered with the tile block but any trouble because weight of the tile block is not applied to the flat portion.

In the illustrated embodiment, all the first projections 28 are held on the holding elements of the backing members 26. However, it is not limited to such construction. For example, the first projections 28 may be alternately held on the backing members 26. The backing member 26 is formed into a hat-like shape in section, however, it is formed into any other suitable shape.

As described above, the embodiment shown in FIGS. 9 and 10 is constructed in the manner that the holding elements are formed at the backing member at predetermined intervals by raising to hookedly engage the holding elements with at least a part of the first projections of the mounting plate, resulting in the mounting plate being fixedly supported on the backing member. Such construction eliminates formation of mounting holes at the backing member and fabrication of the backing member, to thereby effectively prevent deterioration of strength of the mounting plate and leakage of water through the mounting plate. Also, the embodiment permits mounting of the tile mounting plate on the backing material to be highly readily accomplished, resulting in a significant improvement in operation efficiency.

It will thus be seen that the objects set forth above, and those made apparent from the proceeding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which as a matter of language, might be said to fall therebetween.

What is claimed is:

1. A tile mounting plate for a tiled wall structure comprising:

a plurality of first laterally extending projections vertically arranged at intervals corresponding to intervals of vertical arrangement of tile blocks on the tile mounting plate, each of said tile blocks being formed on an inner surface thereof with a dovetail groove;

said first projection being formed into dimensions sufficient to cause it to be loosely fitted in said dovetail groove of said tile block; and a plurality of second laterally extending projections each arranged below each of said first projections so as to form tile support means for fixedly supporting said tile blocks thereon in cooperation with the first projection adjacently positioned above said second projection;

each of said first projections being expandedly formed so as to include an obliquely upwardly extending upper wall for engagedly supporting an upper surface of said dovetail groove of said tile block thereon, an obliquely downwardly extending lower wall and a front wall for connecting said upper wall and lower wall to each other therethrough and abuttedly supporting a bottom surface of said dovetail groove of said tile block thereon, resulting in a dovetail groove therein;

each of said second projections being formed into a shape sufficient to cause tile holding means to be fixedly interposed between said lower wall of said first projection and said second projection to securely hold said tile block on said tile holding means and cause said second projection to abuttedly support said inner surface of said tile block;

each of said second projections being formed into a height smaller than that of said first projection so that a difference between the heights of said first and second projection is substantially equal to a depth of said dovetail groove of said tile block.

2. A tile mounting plate as defined in claim 1, wherein each of said second projections is expandedly formed so as to include an obliquely upwardly extending upper wall for causing said tile holding means to be fixedly interposed between said second projection and said lower wall of said first projection, an obliquely downwardly extending lower wall and a front wall for connecting said upper wall and lower wall to each other therethrough and abuttedly supporting said inner surface of said tile block thereon, resulting in a dovetail groove being defined therein.

3. A tile mounting plate as defined in claim 2, wherein said front wall of said second projection is flatly formed.

4. A tile mounting plate as defined in claim 1, wherein said first projections are vertically arranged at intervals larger than a vertical length of said tile block.

5. A tile mounting plate as defined in claim 1, wherein said front wall of said first projection is curved.

6. A tile mounting plate as defined in claim 1, wherein said tile mounting plate is formed by forming.

7. A support structure for a tiled wall comprising:

a tile mounting plate for mounting thereon tile blocks each having a dovetail groove formed on an inner surface thereof;

at least one backing member for mounting said tile mounting plate on a wall base of a building;

said tile mounting plate being formed thereon with a plurality of laterally extending projections which are arranged in a manner to be parallel to one another in a vertical direction of said tile mounting plate at intervals corresponding to intervals between said tile blocks vertically arranged adjacent to each other and each of which is formed into dimensions sufficient to cause it to be loosely fitted in said dovetail groove of said tile block;

each of said projections being expandedly formed so as to define a dovetail groove therein;

said backing member being formed on a surface thereof facing said tile mounting plate with raised projections hookedly engaged with an inner surface of said dovetail groove of at least a part of said projections of said tile mounting plate at predetermined intervals in a manner to be obliquely upwardly projected.

8. A support structure as defined in claim 7, wherein said raised projections of said backing member are arranged at intervals substantially equal to those of arrangement of said projections and hookedly engaged with all of said projections.

9. A tile mounting plate as defined in claim 8, wherein said backing member is formed into a substantially hat-like shape in section so as to include a substantially U-shaped body and flanges provided on both sides of said body, said raised projections being formed at said flanges.

10. A tiled wall structure comprising:

a plurality of tile blocks each formed on an inner surface thereof with a dovetail groove;

a tile mounting plate formed thereon with a plurality of first laterally extending projections and a plurality of second laterally extending projections;

said first projections being vertically arranged parallel to one another at intervals corresponding to intervals between the tile blocks vertically arranged adjacent to each other and each being formed into dimensions sufficient to cause it to be loosely fitted in said dovetail groove of said tile block;

each of said second projections being arranged below each of said first projections so as to form tile support means for securely supporting tile blocks thereon in cooperation with said first projection adjacently positioned above said second projection;

at least one backing member for mounting said tile mounting plate on a wall base of a building; and an elastic fixture for holding each of said tile blocks on said tile mounting plate;

each of said first projections being expandedly formed so as to include an obliquely upwardly extending upper wall for engagedly supporting an upper surface of said dovetail groove of said tile block thereon, an obliquely downwardly extending lower wall and a front wall for connecting said upper wall and lower wall to each other therethrough and abuttedly supporting a bottom surface of said dovetail groove of said tile block thereon, resulting in defining a dovetail groove therein;

each of said second projections being formed into a shape sufficient to cause said elastic fixture to be fixedly interposed between said lower wall of said first projection and said second projection to securely hold said tile block on said elastic fixture and cause said second projection to abuttedly support said inner surface of said tile block;

each of said second projections being formed into a height smaller than that of said first projection so that a difference between the heights of said first and second projection is substantially equal to a depth of said dovetail of said tile block;

said backing member being formed on a surface thereof facing said tile mounting plate with raised projections hookedly engaged with an inner surface of said dovetail groove of at least a part of said projections of said tile mounting plate at predetermined intervals in a manner to be obliquely upwardly projected;

said elastic fixture being securely interposed between said lower wall of said first projection of said tile mounting plate and said second projection to elastically pressedly hold said tile block supported on said first projection through said dovetail groove of said tile block with respect to said tile supporting plate.

11. A tiled wall structure as defined in claim 10, wherein said lower wall of said dovetail groove of said tile block is formed with a holding recess with which said elastic fixture is pressedly engaged.

12. A tiled wall structure as defined in claim 10, wherein said tile block is formed into a vertical length smaller than said interval between said first projections.

13. A tiled wall structure as defined in claim 10, wherein said tile block is formed into a vertical length larger than said interval between said first projections.

14. A tiled wall structure as defined in claim 10, wherein said tile block is formed at a lower end of said inner surface thereof with a cutout and projected at an upper end thereof so that said projected upper end of upper one of vertically adjacent two tile blocks arranged on said tile mounting plate is partially inserted in said cutout of lower one of said tile blocks.

15. A tiled wall structure as defined in claim 10, wherein said elastic fixture includes a holding section securely interposed between said lower wall of said first projection and said second projection and an engagement section pressedly engaged with a lower surface of said dovetail groove of said tile block.

16. A tiled wall structure as defined in claim 15, wherein said holding section of said elastic fixture is formed into a substantially dogleg-like shape and said engagement section of said elastic fixture extends obliquely downwardly extends from said holding section and is formed into an inverted dogleg-like shape.

17. A tiled wall structure as defined in claim 16, wherein said engagement section of said elastic fixture is formed by raising a part of said holding section.

* * * * *